US009120143B2

(12) United States Patent
Carper

(10) Patent No.: US 9,120,143 B2
(45) Date of Patent: Sep. 1, 2015

(54) CUT-OFF END SURFACE IMPROVEMENT

(71) Applicant: National Machinery LLC, Tiffin, OH (US)

(72) Inventor: Jeffrey W. Carper, Tiffin, OH (US)

(73) Assignee: NATIONAL MACHINERY LLC, Tiffin, OH (US)

( * ) Notice: Subject to any disclaimer, the term of this patent is extended or adjusted under 35 U.S.C. 154(b) by 306 days.

(21) Appl. No.: 13/741,557

(22) Filed: Jan. 15, 2013

(65) Prior Publication Data

US 2014/0196518 A1 Jul. 17, 2014

(51) Int. Cl.

| | |
|---|---|
| ***B21K 27/06*** | (2006.01) |
| ***B21F 5/00*** | (2006.01) |
| ***B21J 1/02*** | (2006.01) |
| ***B21J 9/02*** | (2006.01) |
| *B21F 1/00* | (2006.01) |

(52) U.S. Cl.

CPC . *B21K 27/06* (2013.01); *B21F 5/00* (2013.01); *B21F 5/005* (2013.01); *B21J 1/02* (2013.01); *B21J 9/022* (2013.01); *B21F 1/00* (2013.01)

(58) Field of Classification Search

CPC ..... B21F 1/00; B21F 1/004; B21F 5/00; B21F 5/005; B21F 9/005; B21F 9/007; B21J 9/022; B21J 5/08; B21J 1/04; B21J 9/06; B21J 1/02; B21D 22/04; B21D 22/286; B21K 27/06

USPC ..... 72/40, 41, 57, 267, 352, 353.2, 354.2, 72/354.6, 354.8, 362, 404, 405.01

See application file for complete search history.

(56) References Cited

U.S. PATENT DOCUMENTS

| | | | | | |
|---|---|---|---|---|---|
| 3,101,534 | A | * | 8/1963 | Lange | 72/254 |
| 3,124,876 | A | * | 3/1964 | Putetti | 72/334 |
| 4,882,924 | A | * | 11/1989 | Kohama et al. | 72/254 |
| 4,939,829 | A | * | 7/1990 | Maki et al. | 29/893.34 |
| 5,755,129 | A | * | 5/1998 | Yamasaki | 72/57 |
| 5,870,923 | A | * | 2/1999 | Eisen et al. | 72/377 |

(Continued)

FOREIGN PATENT DOCUMENTS

| | | | |
|---|---|---|---|
| JP | 63-299839 | A | 12/1988 |
| JP | 3180238 | A | 8/1991 |
| SU | 373076 | A | 5/1973 |

(Continued)

OTHER PUBLICATIONS

Notification of Transmittal of the International Search Report and the Written Opinion of the International Searching Authority, or the Declaration for PCT/US2013/075605, filed Dec. 17, 2013; International Search Report and Written Opinion of the International Searching Authority dated Apr. 3, 2014.

*Primary Examiner* — A. Dexter Tugbang
*Assistant Examiner* — Joshua D Anderson
(74) *Attorney, Agent, or Firm* — Pearne & Gordon LLP

(57) ABSTRACT

A method of improving the surface finish of a sheared end face of a cylindrical blank in a progressive forming machine comprising deforming the end face out of its original as sheared transverse plane into a first shape concentric with the axis of the blank that slightly departs from the original plane a distance that increases with proximity to the axis of the blank, thereafter deforming the end face from the first shape into a second shape in a direction opposite a direction the first shape was displaced from the original shear plane, the second shape slightly departing from a transverse plane a distance that increases with proximity to the axis of the blank.

7 Claims, 1 Drawing Sheet

(56) References Cited

U.S. PATENT DOCUMENTS 6,113,514 A * 9/2000 Okubo et al. ..... 476/40
7,827,842 B2 * 11/2010 Hase et al. ..... 72/342.2

FOREIGN PATENT DOCUMENTS

SU 1756007 A1 8/1992
SU 1804367 A3 3/1993

* cited by examiner

CUT-OFF END SURFACE IMPROVEMENT

BACKGROUND OF THE INVENTION

The invention relates to metal forming and, in particular, to a method of improving the surface finish of a sheared end face of a blank being formed in a progressive forming machine.

PRIOR ART

Typically, a progressive forming machine shears wire stock into cylindrical blanks that are transferred from workstation to workstation in the machine. Ordinarily, the blank is incrementally reshaped with punches and dies at the successive workstations to achieve a desired final part configuration. The end faces of the original blank are usually characterized by a relatively rough surface finish. As the blank end faces are struck or bolstered by the tooling in the workstations, some of the original surface roughness is eliminated. However, even when the blank is subjected to high compressive forces in reshaping blows, the sheared end surface can have a residual surface roughness. The resulting surface roughness may be unsatisfactory for some applications because of the intended function of the finished part or for aesthetic reasons. There has existed a long felt need for a simple, effective process to obtain a smooth surface finish on the sheared end surface areas of metal blanks formed in a progressive forming machine.

SUMMARY OF THE INVENTION

The invention provides a method of greatly improving the surface finish of a sheared blank end in a progressive forming machine. The process involves a sequence of steps in which an end surface is forced into a non-planar configuration, is then driven into a reverse configuration and then, is optionally flattened. In the preferred embodiment, the first blow forces the end face into a concave configuration and at a successive station the end face is forced into a convex configuration.

As disclosed, auxiliary steps are performed to facilitate the transition of the end face between the concave and convex stages. The blank adjacent its end is tapered so that it is smallest at the end face prior to being formed into a convex shape. The taper advantageously ensures that the blank end material is not radially restricted and caused to flash around the punch when it is being reshaped. The tool or punch that converts the end face from concave to convex has a unique central vent for exhausting oil/coolant and/or air, thereby preventing these fluids from obstructing the blank end material from closely conforming to the face of the tool. After the blank end surface is reshaped from the original shear plane to a concave shape and then to a convex shape, it is preferably finally flattened to achieve a quality finish.

DESCRIPTION OF THE PREFERRED EMBODIMENTS

Figure 5:
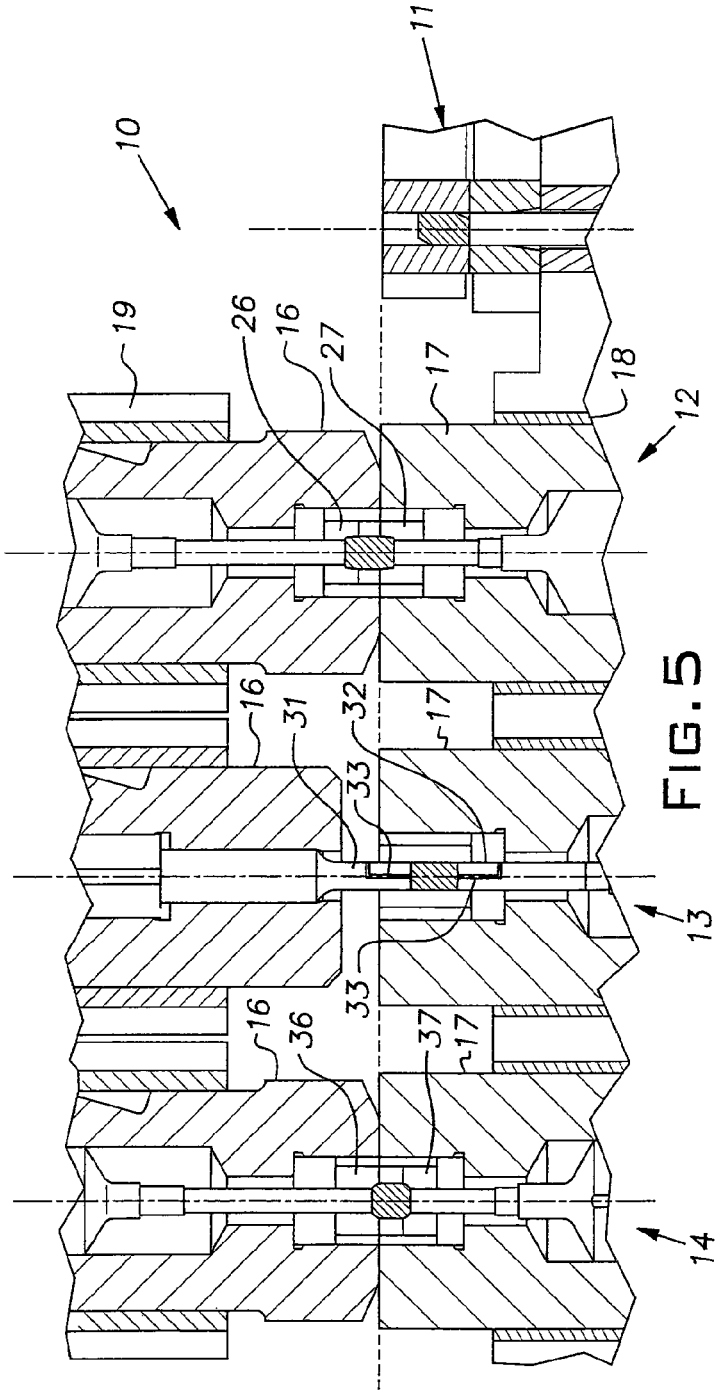
FIG. 5 is a somewhat schematic fragmentary plan view of several stations of a progressive forming machine used to perform the inventive method.

FIG. 5 illustrates parts of a progressive forming machine 10 including a cutoff station 11 and several regularly spaced workstations 12-14. Each workstation 12-14 has a pair of opposed punch and die holders 16, 17. The die holders 17 are stationarily mounted on a die breast or bolster diagrammatically illustrated at 18 and the punch holders 16 are mounted on a ram or slide diagrammatically indicated at 19.

Figure 1:
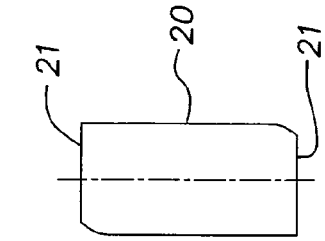
FIG. 1 illustrates a blank, in side view, as sheared from a wire coil or bar.

Referring to FIG. 1 and the extreme right in FIG. 5, a generally cylindrical metal blank 20 of steel, copper, brass, aluminum or other metal is sheared at the cutoff station 11 from a supply of coiled wire or, less frequently, from an elongated bar. The leading and trailing sheared end faces 21 of the blank 20 are nominally planar and transverse to the blank axis. As is customary, the blank 20 is oriented such that its axis is parallel to axes of successive workstations 12-14 to which it is transferred and to the axis of reciprocation of the ram 19. As is also customary, a mechanical transfer device, not shown, transfers a blank 20 from the cutoff station 11 and the workstations 12-14 during a cycle of reciprocation of the ram 19.

The sheared end face 21 of the blank 20 deviates from a true plane, as is somewhat exaggerated in FIG. 1, owing to a slight round-over where the blank is engaged by cutting edges of the shear. Additionally, in the nature of a solid, the main area of the sheared end face 21 is somewhat rough since it is the result of a fracture of the blank material.

In normal prior art practice, the rough surface finish of the sheared end faces 21 is somewhat improved as the blank is progressively deformed in successive workstations into a desired ultimate shape. This incidental surface finish improvement can satisfy many applications but such a finish can be unsatisfactory where the sheared end face area needs a high quality surface finish or smoothness. This can be true even when the applied forming pressures are extreme. Experience has shown that even when forming pressures are very high, a sheared surface can resist conforming perfectly to the tooling surface and will retain at least some degree of its original surface irregularity.

Figure 2:
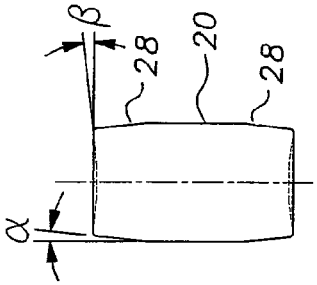
FIG. 2 illustrates the blank after a first forming blow.

From the cutoff station 11, the blank 20 is transferred to the first station 12. Punch and die assemblies 26, 27 are configured to taper both ends 28 of the blank 20 in the manner of a barrel so that the outside diameter of the blank at both ends is progressively smaller with increasing proximity to the blank end face 21. Where the taper is a simple angle, the angle $\alpha$ (FIG. 2) at each side of the blank 20 can range between about 3 degrees to about 15 degrees and is preferably about 4.5 degrees. Additionally, the punch and die assembly tools 26, 27 make the end faces 21 concave when the ram 19 reaches the forward dead center position of FIG. 5. In the illustrated embodiment, the concave end faces are caused by the punch and die assemblies 26, 27 to take the form of shallow cones concentric with the blank axis. The cone angle $\beta$ (FIG. 2) can range from about 3 degrees to about 10 degrees and is preferably about 5 degrees. The forming action at the first station 12 is a combination of an upset resulting in an increase in diameter of the mid-section of the blank 20 and an extrusion in which the end portions of the blank are reduced in diameter from the original diameter of the cylindrical blank 20. Preferably, the tooling 26, 27 at front dead center enclose a space that is slightly greater than the volume of the blank so that the tooling space is not completely filled and the corners between the blank end faces and the blank sidewalls have a small radius.

Figure 3:
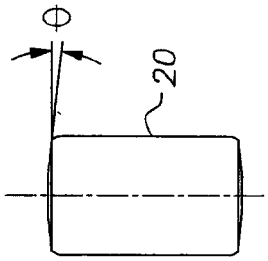
FIG. 3 illustrates the blank after a second forming blow.

The blank 20 is transferred to the second workstation 13 where punch and die tools 31, 32 are shaped to reverse the concave configuration of the blank end faces. The tools 31, 32 form the blank end faces 20 into shallow convex shapes. Preferably, these shapes take the form of shallow cones concentric with the blank axis, for example extending along a line, at each side, at an angle θ (FIG. 3) of about 3 degrees to about 10 degrees and preferably about 5 degrees.

The cavity volume formed by the punch and die tools 31, 32 at front dead center at this station 13, like that of the first station 12, is slightly larger than the volume of the blank 20. The tapered blank ends formed at the first station enable the blank end faces 21 to freely upset radially outward at this second station 13, mostly without confinement, so that flash between the tools confining the end faces 21 and the tools surrounding the blank sidewall is avoided.

A unique feature of the punch and die tools 31, 32 is the provision of a small central axial vent 33 disposed at the center of the blank end faces, that is, on the central axis of the blank and tools. The vents 33 allow for the escape of air, coolant and/or lubricant from the initial space between the tools 31, 32 and respective blank end faces 20. The vents 33 are less than 1/32 inch and preferably are about 0.6 mm or 0.024 mm in diameter. These fluids, if otherwise trapped between a tool and blank because of a seal that is formed at the periphery of the end face 20, would prevent a blank end from being properly reformed by the tool.

Figure 4:
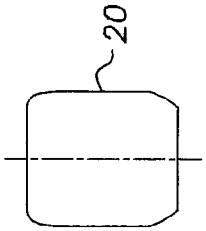
FIG. 4 illustrates the blank after a third forming blow.

The blank 20 with the convex end faces is transferred to the third workstation 14 where the end faces are flattened by punch and die elements 36, 37 into a plane perpendicular to the blank axis (FIG. 4). As before, the cavity space afforded by the tooling 36, 37 is preferably slightly greater than the volume of the blank.

The disclosed process of first making the blank end faces concave, then convex, and then preferably finally flat, has been found to greatly improve the surface smoothness of a blank end face. It has been found that the disclosed process can, for example, achieve a surface finish with steel of $R_z$=16 or less under ISO 468-1982(F). The functionality and/or aesthetics of the surface is thereby significantly improved over that which ordinarily occurs when a blank is directly formed into a desired shape.

While the invention has been disclosed as applied to both ends of a blank some products being formed in a forming machine may only require or be benefitted by treating one end face of the blank to the disclosed concave/convex surface reconfiguration. The workstations in such instances can be used to shape the opposite end of the blank towards a final configuration. While not as effective, the sequence of reforming an end face from its original flat sheared condition to slightly non-planar configurations can be reversed such that the blank is initially worked to make the sheared end face convex and is then worked to make the end face concave and thereafter flattened.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A method of improving the surface finish of a sheared end face of a cylindrical blank in a progressive forming machine comprising the steps, all performed in the forming machine, of shearing the blank from wire or bar stock across a plane transverse to a longitudinal axis of the blank, deforming a full end face of the cylindrical blank out of an original as sheared transverse plane into a first shallow cone shape concentric with the longitudinal axis of the cylindrical blank that departs from the original as sheared transverse plane a distance that increases with proximity to the longitudinal axis of the cylindrical blank, thereafter in the next forming step on said full end face deforming the first shallow cone shape of the end face into a second shallow cone shape in a direction opposite a direction the first shallow cone shape was displaced from the original as sheared transverse plane, the second shallow cone shape departing from a transverse plane a distance that increases with proximity to the longitudinal axis of the blank.

2. A method as set forth in claim 1, wherein the steps are performed such that the first and second shallow cone shapes each depart from said original as sheared transverse plane at an angle between about 3 degrees to about 10 degrees.

3. A method as set forth in claim 1, wherein the steps are performed such that the first and second shallow cone shapes depart from said original as sheared transverse plane at an angle of about 5 degrees.

4. A method as set forth in claim 1, wherein the first shallow cone shape is caused to be concave.

5. A method as set forth in claim 4, wherein the blank is formed with a taper at an end of the cylindrical blank when the first shallow cone shape is formed.

6. A method as set forth in claim 4, wherein a centrally vented tool face is used to transform the blank end face from said concave shape to a convex shape.

7. A method as set forth in claim 6, wherein said convex end face is flattened into a plane transverse to the longitudinal axis.

* * * * *